United States Patent [19]

Suzuki et al.

[11] Patent Number: 4,601,967

[45] Date of Patent: Jul. 22, 1986

[54] TONER PARTICLES HAVING A RELATIVELY HIGH SPECIFIC VOLUME RESISTIVITY COATING LAYER

[75] Inventors: Akira Suzuki, Mishima; Kazuo Kobayashi; Sigekazu Enoki, both of Kawasaki, all of Japan

[73] Assignee: Ricoh Company, Ltd., Tokyo, Japan

[21] Appl. No.: 679,054

[22] Filed: Dec. 6, 1984

[30] Foreign Application Priority Data

Dec. 10, 1983 [JP] Japan ..... 58-232249
Dec. 10, 1983 [JP] Japan ..... 58-232250

[51] Int. Cl.[4] ..... G03G 9/00; G03G 9/10; G03G 9/14; G03C 1/72

[52] U.S. Cl. ..... 430/107; 430/106; 430/106.6; 430/108; 430/110; 430/111; 430/138

[58] Field of Search ..... 430/138, 106.6, 107, 430/106, 110, 111, 108

[56] References Cited

U.S. PATENT DOCUMENTS

| | | | |
|---|---|---|---|
| 3,639,245 | 2/1972 | Nelson | 252/62.1 |
| 4,254,201 | 3/1981 | Sawai et al. | 430/138 X |
| 4,265,993 | 5/1981 | Kawanishi et al. | 430/106.6 |
| 4,433,042 | 2/1984 | Kawanishi et al. | 430/106.6 X |
| 4,442,194 | 4/1984 | Mikami | 430/138 X |
| 4,450,221 | 5/1984 | Terada et al. | 430/138 |
| 4,468,444 | 8/1984 | Mikami et al. | 430/138 |
| 4,468,445 | 8/1984 | Kelly et al. | 430/108 |
| 4,486,502 | 12/1984 | Hara et al. | 430/106.6 |
| 4,513,075 | 4/1985 | Narusawa et al. | 430/108 |

FOREIGN PATENT DOCUMENTS

| | | | |
|---|---|---|---|
| 0048241 | 4/1979 | Japan | 430/106.6 |
| 0118049 | 10/1979 | Japan | 430/106.6 |
| 0059457 | 4/1983 | Japan | 430/106.6 |
| 2128350 | 4/1984 | United Kingdom | 430/111 |

OTHER PUBLICATIONS

IBM Technical Disclosure Bulletin, vol. 8, No. 1, Jun. 1965, p. 28.

Abstract of Japanese Laid-Open Patent Application No. 56-142540.

*Primary Examiner*—John E. Kittle
*Assistant Examiner*—Mukund J. Shah
*Attorney, Agent, or Firm*—Oblon, Fisher, Spivak, McClelland & Maier

[57] ABSTRACT

A toner for developing latent electrostatic images is disclosed, which consists of toner particles, with each toner particle consisting of (i) a core particle comprising an electroconductive material and/or magnetic powder and a binder agent, having a specific volume resistivity ranging from $10^2$ ohm-cm to $10^9$ ohm-cm and (ii) a coating layer comprising a coloring agent such as carbon black, or magnetic powder and a binder agent, having a specific volume resistivity of $10^9$ ohm-cm or more.

18 Claims, 3 Drawing Figures

TONER PARTICLES HAVING A RELATIVELY HIGH SPECIFIC VOLUME RESISTIVITY COATING LAYER

BACKGROUND OF THE INVENTION

The present invention relates to a toner for developing latent electrostatic images in electrophotography, electrostatic recording, electrostatic printing and the like. More particularly it relates to a toner whose electric conductivity sharply changes, depending upon the intensity of the electric field applied thereto, at a predetermined breakdown electric field, thus development of latent electrostatic images and image transfer of the developed toner images can be effectively performed under application of electric fields having different intensities.

As a conventional method of developing latent electrostatic images, there is known a developing method using a one-component type magnetic toner which consists of an electroconductive magnetic toner. In this method, an electroconductive magnetic toner is attracted to and held on the surface of an electroconductive non-magnetic carrier sleeve having an inner magnet. By the relative movement of the carrier sleeve and the inner magnet, the toner held on the electroconductive non-magnetic carrier sleeve is brought into contact with latent electrostatic images formed on a latent electrostatic image bearing member which is backed with an electroconductive backing member. As a result, an electroconductive path is formed, which electrically connects the electroconductive backing member, the toner particles and the carrier sleeve, so that an electric charge having a polarity opposite to the polarity of the latent electrostatic images is induced in the magnetic toner and the latent electrostatic images are developed to visible toner images by the toner.

As disclosed, for example, in U.S. Pat. No. 3,639,245, an electroconductive magnetic toner employed in such a development method consists of toner particles whose surface portion is more electroconductive than the inner portion thereof. This electroconductive magnetic toner has the shortcoming that toner images developed by this magnetic toner are difficult to transfer to a recording medium, for instance, to an image transfer sheet, by an electrostatic image transfer method of applying an electric field to the toner images. In other words, the electrostatic image transfer performance of the toner is poor.

In order to improve the electrostatic image transfer performance, a magnetic toner having high electric resistivity has been proposed. Such a magnetic toner is in fact improved on the electrostatic image transfer performance, but has the shortcoming that image development performance is reduced due to the high resistivity of the toner.

Under such circumstance, there is disclosed in Japanese Laid-Open Patent Application No. 56-142540 a developer as being excellent in both development performance and image transfer, which consists of (i) magnetic toner particles having high electric resistivity, with magnetic powder being dispersed in each toner particle, and (ii) electroconductive magnetic particles having a mean volume diameter smaller than that of the toner particles. This developer, however, has the shortcoming that it is difficult to maintain a predetermined mixing ratio of the high resistivity magnetic toner particles and the electroconductive magnetic toner particles while in use.

SUMMARY OF THE INVENTION

It is therefore an object of the present invention to provide a toner for developing latent electrostatic images which is excellent in both image development performance and electrostatic image transfer performance.

According to the present invention, this object is attained by a toner consisting of toner particles, with each toner particle consisting of (i) a core particle comprising an electroconductive material and/or magnetic powder and a binder agent, having a specific volume resistivity ranging from $10^2$ ohm-cm to $10^9$ ohm-cm and (ii) a coating layer comprising a coloring agent such as carbon black, or magnetic powder and a binder agent, having a specific volume resistivity of $10^9$ ohm-cm or more.

DETAILED DESCRIPTION OF THE PREFERRED EMBODIMENTS

Figure 1:
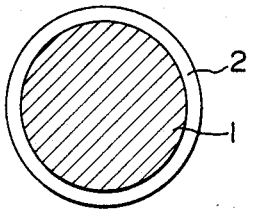
FIG. 1 shows an enlarged schematic cross-sectional view of a toner particle of an embodiment of a toner according to the present invention.

Referring to FIG. 1, an embodiment of a toner according to the present invention will now be explained.

As shown in the figure, the toner particle consists of a core particle 1 having a relatively small specific volume resistivity and a coating layer 2 having a relatively large specific volume resistivity with which the core particle 1 is coated.

The core particle 1 comprises at least a first magnetic powder or an electroconductive material and a binder agent, and the coating layer 2 comprises a second magnetic powder or a coloring agent and a binder agent. It is preferable that the core particle 1 and the coating layer 2 both contain a coloring agent such as carbon black.

More specifically, when a magnetic toner is prepared in accordance with the present invention, it is preferable that the core particle 1 comprise at least a first magnetic powder, an electroconductive material and a first binder agent, and that the coating layer 2 comprise at least a second magnetic powder and a second binder agent, and when necessary, a polarity control agent can be added thereto.

When a non-magnetic toner is prepared in accordance with the present invention, it is preferable that the core particle 1 comprises at least an electroconductive material and a first binder agent, and that the coating layer 2 comprise at least a coloring agent and a second binder resin.

In both the magnetic toner and the non-magnetic toner, it is necessary that the core particle 1 have a specific volume resistivity ranging from $10^2$ ohm-cm to $10^9$ ohm-cm, and the coating layer 2 have a specific volume of $10^9$ ohm-cm or more, which is higher than the specific volume resistivity of the core particle.

As the electroconductive material for both toners, electroconductive carbon black is preferably used in the toner for black-and-white monochrome image formation. In addition to this, metals such as iron, nickel, cobalt and manganese, alloys and oxides of such metals, and copper iodide in the form of powder can be employed.

As the magnetic powder employed for the core particle 1 and for the coating layer 2, magnetizable materials, for instance, metals such as iron, nickel, cobalt and manganese, alloys and oxides of such metals, can be employed in the form of particles having a particle size of 1 μm or less.

As the binder agent, for example, styrene-type resin, acrylic resin, vinyl-type resin, epoxy resin, polyester resin, phenol resin, polyurethane resin, natural resins, celluloses and cellulose derivatives can be employed.

As the coloring agent, pigments and dyes, for instance, carbon black, aniline black, Crystal Voilet, Rhodamine B, Malachite Green, Nigrosine, copper phthalocyanine and azo dyes, can be employed.

In addition to the above, the following can be added: waxes for facilitating image fixing by application of pressure, fatty acids and fatty acid metal salts for preventing the toner from becoming a film which adheres to a photoconductor, silica powder for increasing the fluidity of the toner, and zinc oxide powder for making the toner photoconductive.

In the present invention, when the toner is a magnetic toner, in order to attain better electrostatic image transfer, it is preferable that the toner have a tendency of being triboelectrically charged to a polarity opposite to the polarity of the charge applied to the image transfer sheet at electrostatic image transfer. For causing the toner to have such tendency, materials having high polarity, called "polarity control agent" in this field, can be added to the coating layer 2. Examples of such polarity control agents are Nigrosine, mono-azo dyes, zinc hexadecyl succinate, alkyl esters and alkylamides of naphthoic acid, nitrohumic acid, N,N'-tetramethyldiamine benzophenone, N,N'-tetramethyl-benzidine, triazine, and salicylic acid metal complexes such as Cr, Co and Fe complexes.

In the present invention, when the toner is a magnetic toner as shown in FIG. 1, it is preferable that the amount of the first magnetic powder be in the range of 40 to 100 parts by weight, more preferably in the range of 50 to 80 parts by weight, and the amount of the electroconductive material be in the range of 5 to 80 parts by weight, more preferably in the range of 10 to 40 parts by weight, to 100 parts by weight of the first binder agent in the core particle 1, and the particle size of the core particle 1 be in the range of 1 μm to 50 μm, more preferably in the range of 2 μm to 25 μm.

Further, it is preferable that the amount of the second magnetic powder be in the range of 1 to 30 parts by weight, more preferably in the range of 2 to 20 parts by weight, to 100 parts by weight of the second binder agent in the coating layer 2, and the thickness of the coating layer 2 be not more than 5 μm, more preferably in the range of 0.5 μm to 3 μm.

Furthermore, when the toner is a non-magnetic toner, it is preferable that the amount of the electroconductive material in the core particle 1 be in the range of 5 to 100 parts by weight, more preferably in the range of 10 to 50 parts by weight, to 100 parts by weight of the first binder agent in the core particle 1, and the amount of the coloring agent in the coating layer 2 be in the range of 1 to 30 parts by weight, more preferably in the range of 2 to 20 parts by weight, to 100 parts by weight of the second binder agent in the coating layer 2, and the particle size of the core particle 1 and the thickness of the coating layer 2 be respectively the same as those of the magnetic toner.

Figure 2:
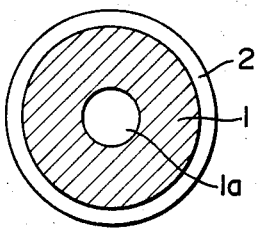
FIG. 2 shows an enlarged schematic cross-sectional view of a toner particle of another embodiment of a toner according to the present invention.

Referring to FIG. 2, another embodiment of a toner according to the present invention will now be explained. As shown in the figure, the toner particle of this embodiment comprises the (i) a core particle 1 including a center core particle 1*a* and (ii) a coating layer 2 with which the core particle 1 is coated.

It is preferable that the center core particle 1*a* be a bead made of, for instance, polystyrene, styrene-acrylic acid copolymer, acrylic acid ester resin, polyester epoxy resin, polycarbonate or a ceramic particle.

The center core particle can be prepared, for instance, by conventional methods such as a spray particle-formation method, or by conventional chemical methods such as suspension polymerization and emulsion polymerization.

It is preferable that the particle size of the center core particle 1*a* be in the range of 1 μm to 20 μm, more preferably in the range of 3 μm to 12 μm.

When the core particle 1 is prepared, the center core particle 1*a* is coated with a coating layer consisting of substantially the same components as in the core particle 1 in the toner particle as shown in FIG. 1 and having a thickness of preferably 0.5 μm to 30 μm, more preferably 1.0 μm to 20 μm, and the remainder of the toner particle is substantially the same as the toner particle shown in FIG. 1 in terms of the particle size of the core particle 1, and the compositions and thickness of the coating layer 2.

The above described toner particles of the toner according to the present invention can by prepared by conventional physical methods and chemical methods.

As the physical methods, for instance, a method of forming particles by rotation, a method of forming particles by fusing, a spray-dry method, a fluidized-coating method, a method of forming particles by stirring and a surface-coating method can be employed.

As the chemical methods, an interfacial polymerization method, an in-liquid harding coating method, a phase separation method from organic solvents, a phase separation method from aqueous solvents, an in-liquid drying method, a fusing-dispersion and cooling method, a capsule content exchange method, and a powder bed method can be employed.

By referring to FIG. 3, the development mechanism of latent electrostatic images being developed by the toner according to the present invention being the image transfer mechanism of the developed toner images being transferred will now be explained.

Figure 3:
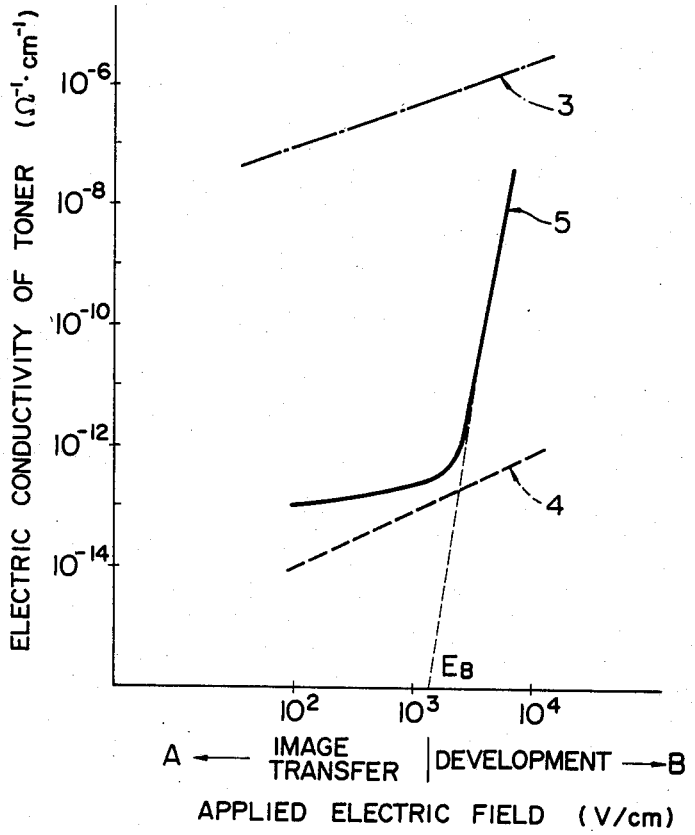
FIG. 3 shows the relationship between the intensity of the electric field applied to the toner according to the present invention and the electric conductivity of the toner under application of the electric field.

In the graph shown in FIG. 3, a line 3 shows the relationship between the intensity of the electric field (V/cm) applied to a conventional electroconductive toner and the electric conductivity ($\Omega^{-1}.cm^{-1}$) of the toner under application of the electric field. As shown by the line 3, the electric conductivity of the toner gradually and linearly increases as the intensity of the applied electric field is increased. The same thing applies to a conventional electrically insulating toner as shown by a line 4.

In sharp contrast to the above, in the case of the toner according to the present invention, its conductivity rapidly increases when the electric field applied to the toner amounts to a certain break-down electric field $E_B$ which exists between $10^2$ V/cm and $10^4$ V/cm, for instance, as shown by a curve 5. In other words, when an electric field having an intensity greater than the break-down electric field $E_B$ is applied to the toner according to the present invention, the toner is electroconductive, while when an electric field having an intensity smaller than the break-down electric field $E_B$ is applied to the toner, the toner is substantially non-conductive.

This fact indicates that the conductivity of the toner according to the present invention sharply varies depending upon the intensity of the electric field applied thereto. Therefore, by changing the intensity of the electric field applied thereto, the toner can be made electroconductive suitably for the development of latent electrostatic images and can also be made electrically insulating suitably for the transfer of toner images to an image transfer sheet, whereby the previously described shortcomings of the conventional toners have been eliminated by the toner according to the present invention.

By referring to the following examples, embodiments of a toner according to the present invention will now be explained in detail.

EXAMPLE 1

Preparation of Core Particles

The following components were mixed.

| | Parts by Weight |
|---|---|
| Styrene | 100 |
| Tri-iron tetroxide | 60 |
| Electroconductive carbon | 20 |
| 2,2'-azobisisobutyronitrile | 2 |
| Diethylaminoethylmethacrylate | 3 |

3 parts by weight of a hydrophilic colloidal silica Aerosol-200 (commercially available from Degussa, Japan Co., Ltd.), 1000 parts by weight of distilled water and the above prepared mixture were placed in a 2-liter separable flask.

The temperature of the mixture was elevated to 70° C., with stirring by a stirrer (T.K. Homo Mixer commercially available from Tokushu Kika Kogyo Co., Ltd.) with a revolution speed of 5000 rpm, to initiate a polymerization reaction, and continuously stirred at 70° C. for 1 hour.

Thereafter, the mixture was stirred by an ordinary stirrer with a revolution speed of 100 rpm at the same temperature for 6 hours to accomplish the polymerization reaction.

After the polymerization reaction, polymerized solid particles were collected by filtering the reaction mixture and dried, whereby core particles having a mean diameter of about 15 μm and a specific volume resistivity ranging from $3.5\times10^7$ ohm-cm to $8.6\times10^7$ ohm-cm were obtained.

Coating of the Core Particles with a Coating Layer

The following components were mixed to prepare a coating liquid for forming a coating layer on the above prepared core particles:

| | Parts by Weight |
|---|---|
| Styrene - methylmethacrylate (70:30) latex liquid | 100 |
| Tri-iron tetroxide (Toda Color EPT-1000 commercially available from Toda Kogyo Corp.) | 2 |
| Water | 100 |

The core particles were placed in a fluidized bed. The above prepared coating liquid was then effectively diluted with an effective amount of water for spraying and was sprayed from the above on the core particles placed in the fluidized bed under application of heat thereto, so that the core particles were coated with a coating layer, whereby a toner consisting of toner particles having a mean diameter of 17 μm, coated with an about 2 μm thick coating layer, was prepared. As to the specific volume resistivity of the coating layer, since the layer was so thin that it was difficult to measure it directly, it was measured indirectly. The result was that the specific volume resistivity of the coating layer was $10^{11}$ ohm-cm or more. Thus, a toner No. 1 according to the present invention of the type as shown in FIG. 1 was prepared.

By use of the toner No. 1 according to the present invention, latent electrostatic images were developed in a commercially available electrophotographic copying machine (Ricopy FT-4700 made by Ricoh Company, Ltd.) under the conditions that the electric field applied to the toner for development was in the range of from $6\times10^3$ V/cm to $2.3\times10^4$ V/cm, and the electric field applied to the toner for image transfer was in the range of from $2\times10^3$ V/cm to $4\times10^3$ V/cm.

The result was that the developed toner image and the transferred images were clear.

EXAMPLE 2

Preparation of Core Particles

A mixture of the following components was heated and kneaded by heating rollers.

| | Parts by Weight |
|---|---|
| Piccolastic D-125 (polystyrene made by Esso Standard Sekiyu K.K.) | 100 |
| Carbon black | 20 |
| 2-hydroxy-3-naphthoic acid isoamylester (a dispersing agent) | 2 |
| Magnetite (having a particle size of 0.1 μm) | 50 |

The kneaded mixture was cooled, crushed and classified, so that particles having a mean diameter of 20 μm were obtained.

The thus obtained particles were caused to pass through a heat-application drying apparatus to make each particle spherical by fusing and were then classified to obtain core particles having a mean diameter of about 16 μm. The specific volume resistivity of the core particles was in the range of from $7.5\times10^7$ ohm-cm to $1.3\times10^8$ ohm-cm.

Coating of the Core Particles with a Coating Layer

The thus prepared core particles were placed in a fluidized bed. A coating liquid prepared in the same manner as in Example 1 was diluted with an effective amount of water for spraying and was sprayed from the above on the core particles placed in the fluidized bed under application of heat thereto to coat the core particles with a coating layer, whereby a toner consisting of toner particles having a mean diameter of 16 μm, coated with an about 1 μm thick coating layer, was prepared. The specific volume resistivity of the coating layer was $10^{11}$ ohm-cm or more, which was the same as that of the coating layer in Example 1. Thus, a toner No. 2 according to the present invention of the type as shown in FIG. 1 was prepared.

By use of the toner No. 2 according to the present invention, latent electrostatic images were developed and the developed toner images were transferred to a transfer sheet by the same electrophotographic copying machine under the same conditions as in Example 1. The result was that the same good results were obtained as in Example 1.

EXAMPLE 3

Preparation of Core Particles

The following components were mixed and polymerized by stirring at temperatures of 60° C. to 65° C. for 8 hours.

| | Parts by Weight |
|---|---|
| Styrene | 90 |
| n-butylmethacrylate | 10 |
| Carbon black (commercially available from Mitsubishi Chemical Industries, Ltd.) | 30 |
| Polypropylene (Viscol 550P commercially available from Sanyo Chemical Industries, Ltd.) (serving as a releasing agent for image transfer rollers) | 5 |
| 2,2'-azobis-(2,4-dimethylvaleronitrile) | 1 |

After the polymerization reaction, polymerized solid particles were collected by filtering the reaction mixture and dried, whereby core particles having a mean diameter of about 15 m and a specific volume resistivity ranging from $1.0\times10^8$ ohm-cm to $3.5\times10^8$ ohm-cm were obtained.

Coating of the Core Particles with a Coating Layer

The following components were mixed to prepare a coating liquid for forming a coating layer on the above prepared core particles:

| | Parts by Weight |
|---|---|
| Styrene - methylmethacrylate (70:30) latex liquid | 100 |
| Carbon black | 1 |

The above prepared coating liquid was diluted with an effective amount of water for spraying and was sprayed from the above on the core particles placed in the fluidized bed under application of heat thereto in the same manner as in Example 1, whereby a toner consisting of toner particles having a mean diameter of about 16 μm, coated with an about 1 μm thick coating layer, was prepared. An indirect measurement of the specific volume resistivity of the coating layer showed that the resistivity was $10^{10}$ ohm-cm or more. Thus, a toner No. 3 according to the present invention of the type as shown in FIG. 1 was prepared.

The thus prepared toner No. 3 was subjected to a latent electrostatic images development test and a toner image transfer test by use of a prototype of an electrostatic recording apparatus based on a recording method named LIST (Latent Image Injecting to Surface of Toner) method disclosed in U.S. Pat. No. 4,446,471, under the conditions that the electric field applied to the toner for development was in the range of from $2.4\times10^4$ V/cm to $4.2\times10^4$ V/cm, and the electric field applied to the toner for image transfer was $5.0\times10^3$ V/cm to $9.3\times10^3$ V/cm.

The result was that clear copies were obtained.

EXAMPLE 4

Preparation of Core Particles

Commercially available pearl-like polystyrene beads having a diameter of about 15 m were placed in a fluidized bed for use as center core particles for preparing the core particles as shown in FIG. 2.

The following components were mixed to prepare a coating liquid:

| | Parts by Weight |
|---|---|
| Styrene-methylmethacrylate (70:30) latex liquid | 100 |
| Tri-iron tetroxide powder | 50 |
| Electroconductive carbon | 20 |
| Water | 100 |

The above prepared coating liquid was diluted with water effectively for spraying. The center core particles were sprayed with the diluted coating liquid from the above of the fluidized bed under application of heat thereto and were then dried, whereby the center core particles were coated with a coating layer having a thickness of about 2 μm and thus core particles were prepared. The specific volume resistivity of the core particles was in the range of from $8.6\times10^6$ ohm-cm to $5.6\times10^7$ ohm-cm.

Coating of the Core Particles with a Coating Layer

The above prepared core particles were placed in a fluidized bed.

The following components were mixed to prepare a coating liquid:

| | Parts by Weight |
|---|---|
| Styrene-methylmethacrylate (70:30) latex liquid | 100 |
| Tri-iron tetroxide powder | 10 |
| Water | 100 |

The above prepared coating liquid was diluted with an effective amount of water for spraying and was sprayed from the above on the core particles placed in the fluidized bed under application of heat thereto, whereby the core particles were coated with a coating layer having a thickness of about 1 μm, so that toner particles having a mean diameter of the particles of about 18 μm were prepared. The specific volume resistivity of the coating layer was $10^{11}$ ohm-cm or more. Thus, a toner No. 4 according to the present invention of the type as shown in FIG. 2 was prepared.

By use of the toner No. 4 according to the present invention, latent electrostatic images were developed and the developed toner images were transferred to an image sheet by the same copying machine (Ricopy FT-4700 made by Ricoh Company, Ltd.) as that employed in Example 1, under the same development and image transfer conditions as in Example 1.

The same good results as in Example 1 were obtained.

EXAMPLE 5

Preparation of Core Particles

The following components were mixed:

| | Parts by Weight |
|---|---|
| Styrene | 100 |
| 2,2'-azobisisobutyronitrile | 2 |
| Diethylaminoethylmethacrylate | 3 |

3 parts by weight of a hydrophilic colloidal silica Aerosol-200 (commercially available from Degussa Japan Co., Ltd.), 1000 parts by weight of distilled water and the above prepared mixture were placed in a 2-liter separable flask.

The temperature of the mixture was elevated to 70° C., with stirring by a stirrer (T.K. Homo Mixer commercially available from Tokushu Kia Kogyo Co., Ltd.) with a revolution speed of 5000 rpm, to initiate a polymerization reaction, and continuously stirred at 70° C. for 1 hour.

Thereafter, the mixture was stirred by an ordinary stirrer with a revolution speed of 100 rpm at the same temperature for 6 hours to accomplish the polymerization reaction.

After the polymerization reaction, polymerized solid particles were collected by filtering the reaction mixture and dried, whereby center core particles having a mean diameter of about 15 μm were obtained.

The following components were mixed to prepare a coating liquid for forming a coating layer on the above prepared center core particles:

| | Parts by Weight |
|---|---|
| Styrene latex liquid | 100 |
| Tri-iron tetroxide powder | 50 |
| Electroconductive carbon | 20 |
| Water | 100 |

The above prepared center core particles were mixed with the above coating liquid and were then sufficiently dispersed. The mixture was subjected to spray-drying, whereby the center core particles were coated with a coating layer having a thickness of about 1.5 μm, and thus core particles having a mean diameter of about 16.5 μm and a specific volume resistivity ranging from $1.8\times10^7$ ohm-cm to $6.8\times10^7$ ohm-cm were prepared.

Coating of the Core Particles with a Coating Layer

The above prepared core particles were mixed well with a mixture of the following components:

| | Parts by Weight |
|---|---|
| Styrene latex liquid | 100 |
| Tri-iron tetroxide powder | 7 |
| Water | 100 |

The mixture was mixed so as to sufficiently disperse the core particles, subjected to spray-drying, whereby the core particles were coated with a coating layer having a thickness of about 1 μm, and thus toner particles having a mean diameter of about 19 μm were prepared. The specific volume resistivity of the coating layer was $10^{11}$ ohm-cm or more. Thus, a toner No. 5 according to the present invention of the type as shown in FIG. 2 was prepared.

By use of the toner No. 5 according to the present invention, development of latent electrostatic images and image transfer of the developed toner images were carried out under the same conditions as specified in Example 1. The result was that the same clear developed images and transferred images were obtained as in Example 1.

EXAMPLE 6

Preparation of Core Particles

The following components were mixed well and dissolved to prepare a solution:

| | Parts by Weight |
|---|---|
| Polystyrene | 100 |
| Toluene | 500 |

This solution was diluted with an effective amount of toluene for spray-drying and was subjected to spray-drying so that polystyrene particles were prepared. The thus prepared polystyrene particles were classified, so that center core particles having a mean diameter of about 18 μm were obtained.

The center core particles were placed in a fluidized bed.

The following components were mixed to prepare a coating liquid for coating the center core particles with the liquid:

| | Parts by Weight |
|---|---|
| Styrene - methylmethacrylate (70:30) latex liquid | 100 |
| Electroconductive carbon | 20 |
| Water | 100 |

The thus prepared coating liquid was sprayed from the above on the center core particles placed in the fluidized bed under application of heat thereto, so that the center core particles were coated with the coating liquid. The thus coated center core particles were dried, whereby core particles coated with a coating layer having a thickness of about 3 μm and a specific volume resistivity ranging from $3.5\times10^7$ ohm-cm to $8.3\times10^7$ ohm-cm were prepared.

Coating of the Core Particles with a Coating Layer

The above prepared core particles were placed in a fluidized bed.

The following components were mixed to prepare a coating liquid.

| | Parts by Weight |
|---|---|
| Styrene - methylmetacrylate (70:30) latex liquid | 100 |
| Carbon black | 2 |
| Water | 100 |

The above prepared coating liquid was diluted with an effective amount of water for spraying and was sprayed from the above on the core particles placed in the fluidized bed under application of heat thereto, whereby the core particles were coated with a coating layer having a thickness of about 1 μm, so that toner particles having a mean particle size of about 23 μm were prepared. The specific volume resistivity of the coating layer was in the range of from $8.5\times10^{10}$ ohm-cm to $9.3\times10^{10}$ ohm-cm. Thus, a toner No. 6 according to the present invention of the type as shown in FIG. 2 was prepared.

By use of the toner No. 6 according to the present invention, latent electrostatic images were developed and the developed toner images were transferred to an image transfer sheet by the same prototype apparatus as that employed in Example 3 under the same development and image transfer conditions as in Example 3.

The result was that the same excellent clear images were obtained as in Example 3.

What is claimed is:

1. A toner for developing latent electrostatic images comprising toner particles, each toner particle comprising a core particle having a specific volume resistivity ranging from $10^2$ ohm-cm to $10^9$ ohm-cm and a coating layer with which the surface of said core particle is coated, having a specific volume resistivity of $10^9$ ohm-cm or more, said core particle comprising an electroconductive material and a binder agent, and said coating layer comprising a binder agent and a component selected from the group consisting of a magnetic material and a coloring agent.

2. A toner as claimed in claim 1, wherein said core particle further comprises a magnetic material.

3. A toner for developing latent electrostatic images as claimed in claim 1, wherein said core particle further comprises a center core particle therein.

4. A toner for developing latent electrostatic images as claimed in claim 2, wherein said core particle further comprises a center core particle therein.

5. A toner for developing latent electrostatic images as claimed in claim 2, wherein the amount of said magnetic material in said core particle is in the range of from 40 parts by weight to 100 parts by weight and the amount of said electroconductive material is in the range of from 5 parts by weight to 80 parts by weight to 100 parts by weight of said binder agent in said core particle, and the amount of said magnetic powder in said coating layer is in the range of 1 parts by weight to 30 parts by weight to 100 parts by weight of said binder agent in said coating layer.

6. A toner for developing latent electrostatic images as claimed in claim 1, wherein the amount of said electroconductive material is in the range of from 5 parts by weight to 100 parts by weight of said binder agent in said core particle, and the amount of said coloring agent is in the range of from 1 part by weight to 30 parts by weight to 100 parts by weight of said binder agent in said coating layer.

7. A toner for developing latent electrostatic images as claimed in claim 1, wherein said core particle has a mean diameter ranging from 1 μm to 50 μm, and said coating layer has a thickness of 5 μm or less.

8. A toner for developing latent electrostatic images as claimed in claim 2, wherein said core particle has a mean diameter ranging from 1 μm to 50 μm, and said coating layer has a thickness of 5 μm or less.

9. A toner for developing latent electrostatic images as claimed in claim 3, wherein said center core particles has a diameter in the range of from 1 μm to 20 μm.

10. A toner for developing latent electrostatic images as claimed in claim 4, wherein said center core particles has a diameter in the range of from 1 μm to 20 μm.

11. A toner for developing latent electrostatic images as claimed in claim 1, wherein said magnetic powder in said coating and said magnetic powder in said core each are selected from the group consising of iron, nickel, cobalt, manganese, and alloys and oxides of iron, nickel, cobalt and manganese.

12. A toner for developing latent electrostatic images as claimed in claim 1, wherein said electroconductive material employed in said core particle is selected from the group consisting of electroconductive carbon black, iron, nickel, cobalt, manganese, and alloys and oxides of iron, nickel, cobalt and manganese.

13. A toner for developing latent electrostatic images as claimed in claim 1, wherein said binder agent in said core and said binder agent in said coating each are selected from the group consisting of styrene-type resin, acrylic resin, vinyl-type resin, epoxy resin, polyester resin, phenol resin, polyurethane resin, natural resins, cellulose and cellulose derivatives.

14. A toner for developing latent electrostatic images as claimed in claim 1, wherein said electroconductive material employed in said core particle is selected from the group consisting of electoconductive carbon black, iron, nickel, cobalt, manganese, and alloys and oxides of iron, nickel, cobalt and manganese.

15. A toner for developing latent electrostatic images as claimed in claim 2, wherein said binder agent in said core and said binder agent in said coating each are selected from the group consisting of styrene-type resin, acrylic resin, vinyl-type resin, epoxy resin, polyester resin, phenol resin, polyurethane resin, natural resins, cellulose and cellulose derivatives.

16. A toner for developing latent electrostatic images as claimed in claim 1, wherein said coloring agent is selected from the group consisting of carbon black, aniline black, Crystal Violet, Rhodamine B, Malachite Green, Nigrosine, copper phthalocyanine and azo dyes.

17. A toner for developing latent electrostatic images as claimed in claim 2, wherein said core particle further comprises a coloring agent selected from the group consisting of carbon black, aniline black, Crystal Violet, Rhodamine B, Malachite Green, Nigrosine, copper phthalocyanine and azo dyes.

18. A toner for, developing latent electrostatic images as claimed in claim 1, wherein said coating layer further comprises a polarity control agent selected from the group consisting of Nigrosine, mono-azo dyes, zinc hexadecyl succinate, alkyl esters and alkylamines of naphthoic acid, nitrohumic acid, N,N'-tetramethyldiamine benzophenone, N,N'-tetramethyl-benzidine, triazine and salicylic acid metal complexes.

* * * * *